US005803548A

United States Patent [19]

Battle

[11] Patent Number: 5,803,548

[45] Date of Patent: Sep. 8, 1998

[54] COLLAPSIBLE CHAIR APPARATUS

[76] Inventor: Elizabeth Taylor Battle, P.O. Box 315, Fernandina Beach, Fla. 32035

[21] Appl. No.: 626,808

[22] Filed: Apr. 3, 1996

[51] Int. Cl.[6] ..... A47C 4/03

[52] U.S. Cl. ..... 297/440.13; 297/271.6

[58] Field of Search ..... 297/440.1, 440.13, 297/440.15, 440.2, 440.21, 440.23, 271.6

[56] References Cited

U.S. PATENT DOCUMENTS

| | | | |
|---|---|---|---|
| D. 264,647 | 6/1982 | Turner . | |
| 2,518,955 | 8/1950 | Stelzer | 297/440.13 |
| 3,909,064 | 9/1975 | Payne, Jr. et al. . | |
| 4,118,064 | 10/1978 | Robeson . | |
| 4,140,065 | 2/1979 | Chacon | 297/440.13 X |
| 4,509,794 | 4/1985 | Roland | 297/440.13 |
| 4,593,950 | 6/1986 | Infanti | 297/440.13 |
| 5,000,514 | 3/1991 | Hanson | 297/440.13 |
| 5,253,921 | 10/1993 | Boulet . | |
| 5,415,454 | 5/1995 | Fu-Tsung . | |

*Primary Examiner*—Peter R. Brown

[57] ABSTRACT

A collapsible chair apparatus includes a pair of planar side panels each of which includes a lower side panel portion which includes a front lower region and a rear lower region. Each side panel also includes an upper side panel portion which extends upward from the rear lower region. A front slot extends into the front lower region. A lower rear slot extends into the rear lower region. An upper rear slot extends into the upper side panel portion and is coplanar with the lower rear slot. A planar back panel includes a pair of lower back slots which are registrable with the lower rear slots of the side panels. A pair of upper back slots in the back panel are registrable with the upper rear slots of the side panels. A lock-tab receiving channel is present in the back panel and is coplanar with the front slots of the side panels. A seat assembly includes a planar seat panel and a spacer element which projects downward from a front portion of the seat panel. The seat panel includes a rear locking tab that is registrable with the lock-tab receiving channel in the back panel and includes a pair of rear seat slots which are registrable with the front slots of the side panels. A locking element is provided which is attachable to the rear locking tab of the seat assembly for locking the seat assembly onto the back panel.

6 Claims, 3 Drawing Sheets

COLLAPSIBLE CHAIR APPARATUS

BACKGROUND OF THE INVENTION

1. Field of the Invention

The present invention relates generally to chairs and, more particularly, to chairs that are readily collapsed and reassembled.

2. Description of the Prior Art

Conventional chairs include back, seat, and leg portions that are generally connected together permanently. As a result, such conventional chairs cannot readily be collapsed so as to occupy less space in storage and so as to be more easily transported from one location to another. However, throughout the years, a number of innovations have been developed relating to collapsible chairs, and the following U.S. Pat. Nos. are representative of some of those innovations: 3,909,064, 4,118,064, 4,593,950, 5,253,921, and 5,415,454. More specifically, U.S. Pat. No. 3,909,064 discloses a knockdown rocking chair which includes a combined seat and back portion which includes a large number of for connecting to side panels. The many slats must be placed in a corresponding number of mortises in the side panels. There are only separate three pieces in the collapsible chair, but there are twenty-four slats that need to be placed in twenty-four mortises. To enable assembly of a collapsible chair to be more simple task, it would be desirable if a collapsible chair did not include a large number of slats that have to be placed in a corresponding large number of mortises.

Each of U.S. Pat. Nos. 4,118,064 and 5,253,921 discloses a folding rocking chair that includes a number of components that are pivotally connected to other components. It is well known that pivotal connections are subject to wear and tear during pivoting action. It is also well known that pivotal connections often develop unpleasant squeaks. In view of these facts, it would be desirable if a collapsible chair did not include pivotal connections between component parts.

U.S. Pat. No. 4,593,950 discloses a collapsible chair that includes two side panels, one back panel, and one seat panel that are connected together by interfitting slots. With respect to the connections between the seal panel and the two side panels, once complimentary interfitting slots are connected together, both vertical and horizontal motion at the interfitting slots are inhibited. However, vertical motion of the back panel with respect to the two side panels and the seat panel is not inhibited. As a result, if someone were to grab the back panel and attempt to lift the chair by the back panel, the back panel may be pulled loose from the chair, and the chair may collapse intentionally. In view of these facts, it would be desirable if a collapsible chair were provided that had interfitting slots, wherein the back of the chair is prevented from disconnecting from the remainder of the chair if the back of the chair is used for lifting the chair vertically.

U.S. Pat. No. 5,415,454 may be of interest for its disclosure of a piece of multi-purpose furniture which includes a pair of side frames, each of which includes a plurality of slots for receiving a variety of different boards to perform a variety of different functions.

Still other features would be desirable in a collapsible chair apparatus. To appeal to children, it would be desirable if a collapsible chair were made available in child-appealing colors. It would be desirable if a collapsible chair were made of light weight materials. It would be desirable if a collapsible chair were presented as a puzzle that can be assembled by a child. In providing a collapsible chair that is readily assembled, disassembled, and reassembled, it would be desirable if the collapsible chair did not require any nails or glue for assembly.

Thus, while the foregoing body of prior art indicates it to be well known to use collapsible chairs, the prior art described above does not teach or suggest a collapsible chair apparatus which has the following combination of desirable features: (1) can readily be collapsed so as to occupy less space in storage and so as to be more easily transported from one location to another; (2) does not include a large number of slats that have to be placed in a corresponding large number of mortises; (3) does not include pivotal connections between component parts; (4) has interfitting slots, wherein the back of the chair is prevented from disconnecting from the remainder of the chair if the back of the chair is used for lifting the chair vertically; and (5) does not require any nails or glue for assembly. The foregoing desired characteristics are provided by the unique collapsible chair apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a collapsible chair apparatus which includes a pair of planar side panels each of which includes a lower side panel portion which includes a front lower region and a rear lower region. Each side panel also includes an upper side panel portion which extends upward from the rear lower region. A front slot extends into the front lower region at a first orientation. A lower rear slot extends into the rear lower region at a second orientation. An upper rear slot extends into the upper side panel portion at the second orientation coplanar with the lower rear slot. A planar back panel includes a pair of lower back slots which are oriented at the second orientation and which are registrable with the lower rear slots of the side panels. A pair of upper back slots in the back panel are oriented at the second orientation and are registrable with the upper rear slots of the side panels. A lock-tab receiving channel is present in the back panel and is coplanar with the front slots of the side panels.

A seat assembly includes a planar seat panel and a spacer element which projects downward from a front portion of the seat panel. The seat panel includes a rear locking tab that is registrable with the lock-tab receiving channel in the back panel and includes a pair of rear seat slots oriented at the first orientation and registrable with the front slots of the side panels. A locking element is provided which is attachable to the rear locking tab of the seat assembly for locking the seat assembly onto the back panel. An arm rest element may be attached to each of the side panels.

The spacer element includes a pair of laterally extending spacer lock tabs, and each of the front lower regions of the side panels includes a spacer-tab receiving notch for receiving a spacer lock tab. When the collapsible chair apparatus is in the form of a rocking chair, each of the lower side panel portions of the side panels includes a rocker portion. The rear locking tab of the seat assembly includes a peg-receiving aperture, and the locking element is comprised of a locking peg which includes a locking portion which is received in the peg-receiving aperture. The first orientation and the second orientation are perpendicular to each other. Preferably, the first orientation is substantially horizontal, and the second orientation is substantially vertical.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved collapsible chair apparatus which has all of the advantages of the prior art and none of the disadvantages.

It is another object of the present invention to provide a new and improved collapsible chair apparatus which may be easily and efficiently manufactured and marketed.

It is a further object of the present invention to provide a new and improved collapsible chair apparatus which is of durable and reliable construction.

An even further object of the present invention is to provide a new and improved collapsible chair apparatus which is susceptible of a low cost of manufacture with regard to both materials and labor, and which accordingly is then susceptible of low prices of sale to the consuming public, thereby making such collapsible chair apparatus available to the buying public.

Still yet a further object of the present invention is to provide a new and improved collapsible chair apparatus which can readily be collapsed so as to occupy less space in storage and so as to be more easily transported from one location to another.

Still another object of the present invention is to provide a new and improved collapsible chair apparatus that does not include a large number of slats that have to be placed in a corresponding large number of mortises.

Yet another object of the present invention is to provide a new and improved collapsible chair apparatus which does not include pivotal connections between component parts.

Even another object of the present invention is to provide a new and improved collapsible chair apparatus that has interfitting slots, wherein the back of the chair is prevented from disconnecting from the remainder of the chair if the back of the chair is used for lifting the chair vertically.

Still a further object of the present invention is to provide a new and improved collapsible chair apparatus which does not require any nails or glue for assembly.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved collapsible chair apparatus embodying the principles and concepts of the present invention will be described.

Figure 1:
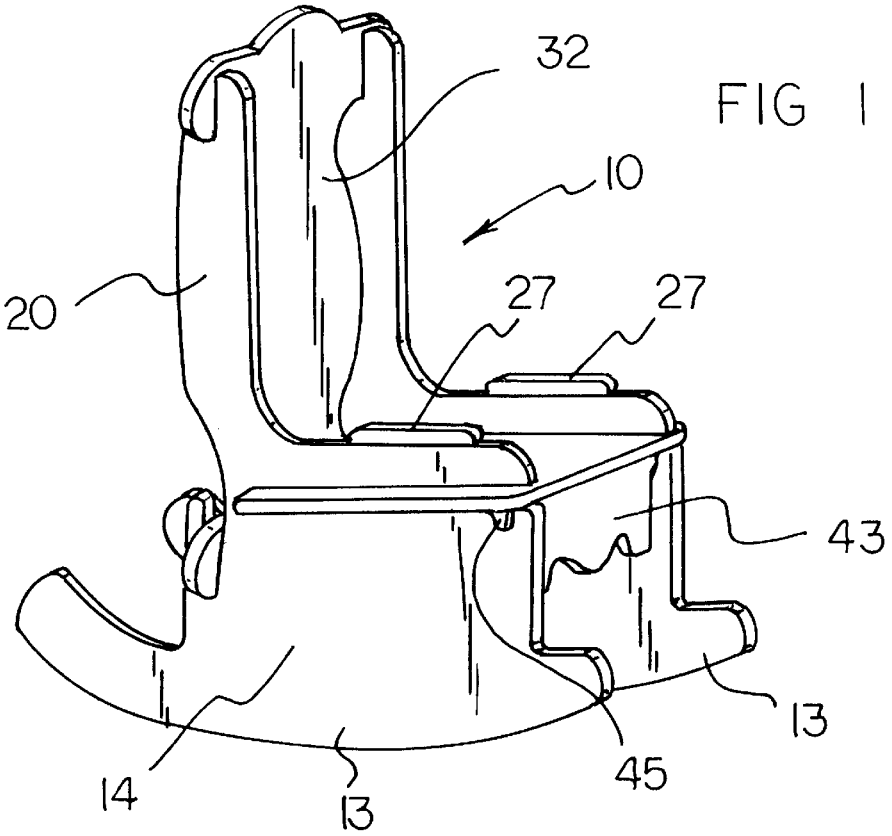
FIG. 1 is a perspective view showing a preferred embodiment of the collapsible chair apparatus of the invention.
Figure 2:
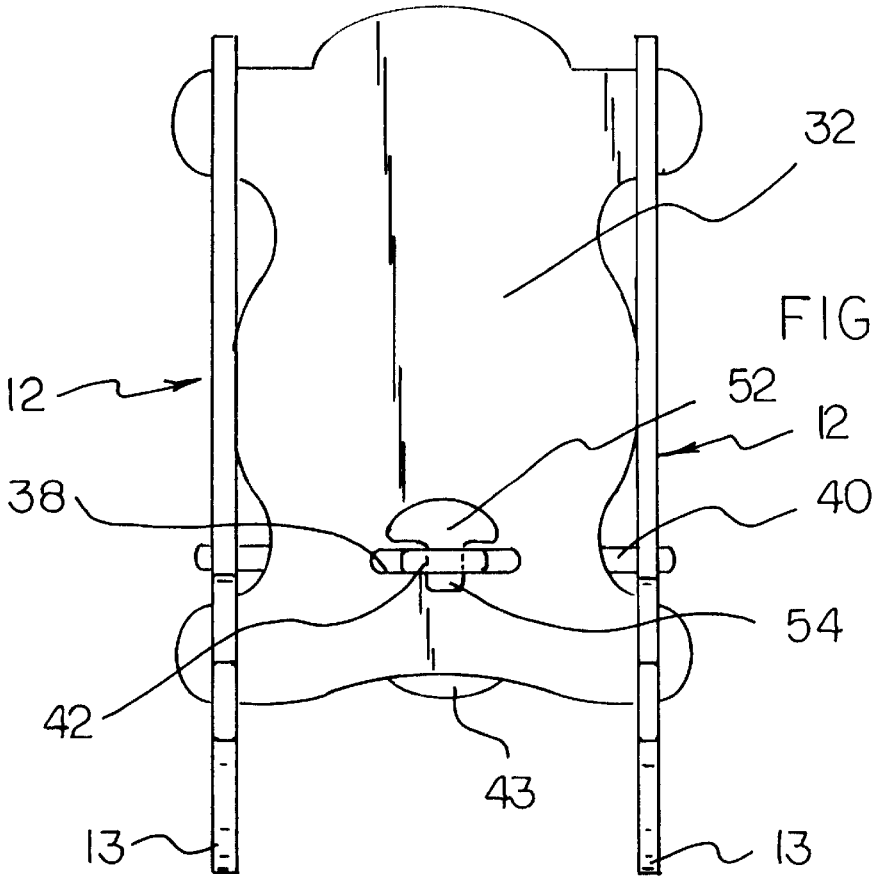
FIG. 2 is an enlarged rear view of the embodiment of the invention shown in FIG. 1.
Figure 3:
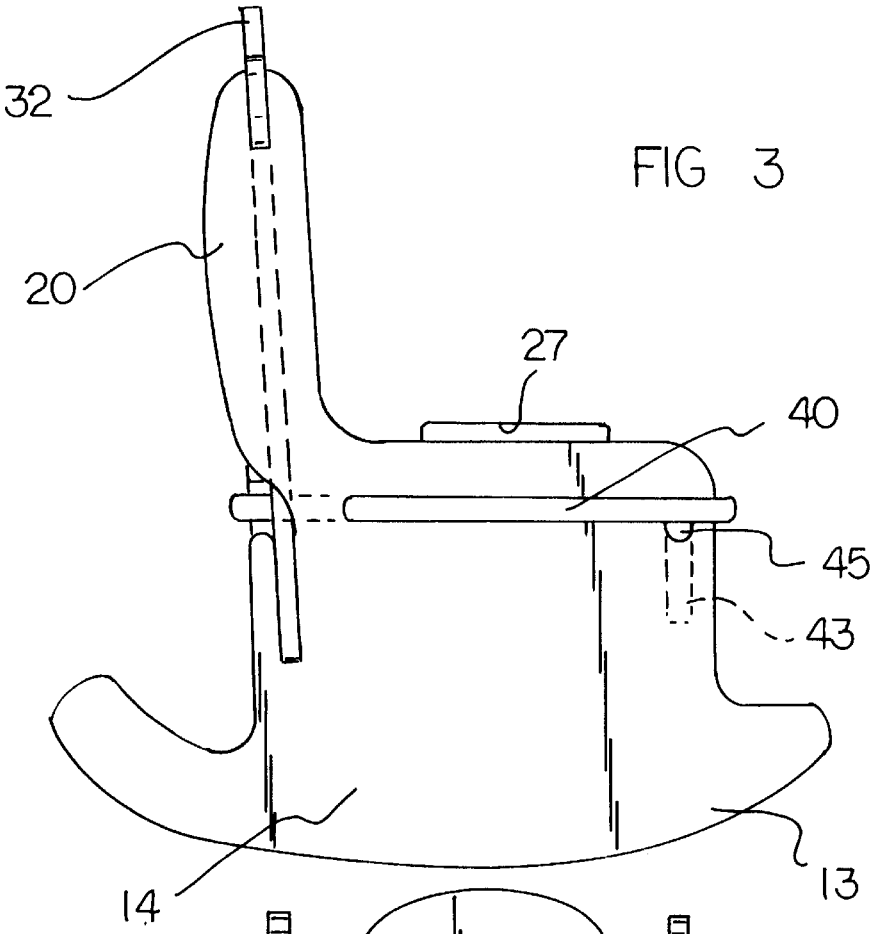
FIG. 3 is a side view of the embodiment of the invention shown in FIG. 1.
Figure 4:
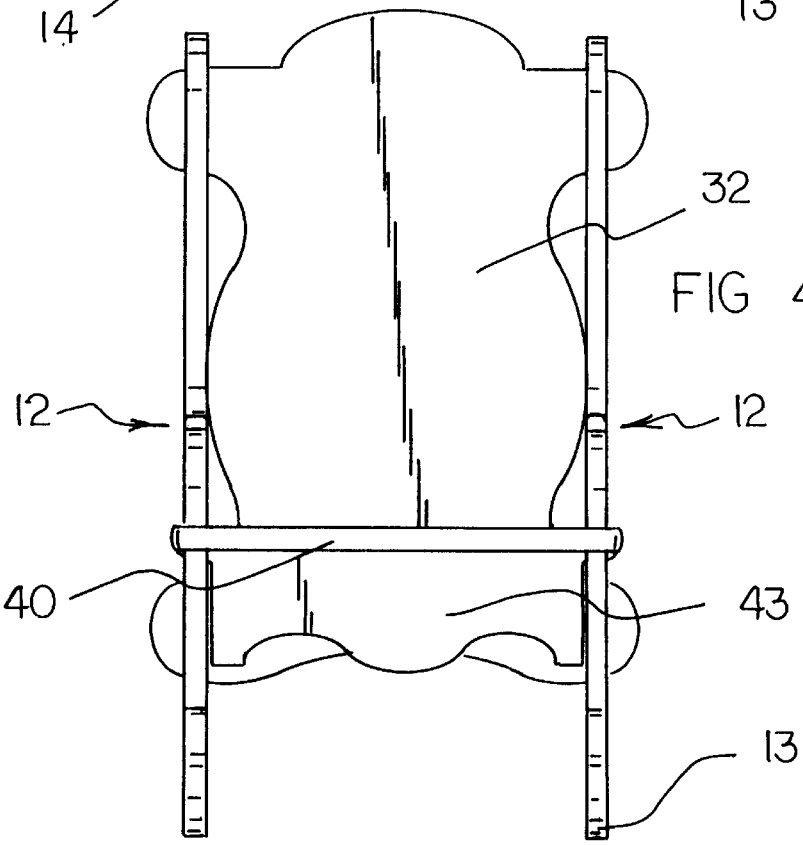
FIG. 4 is a front view of the embodiment of the invention shown in FIG. 1.
Figure 5:
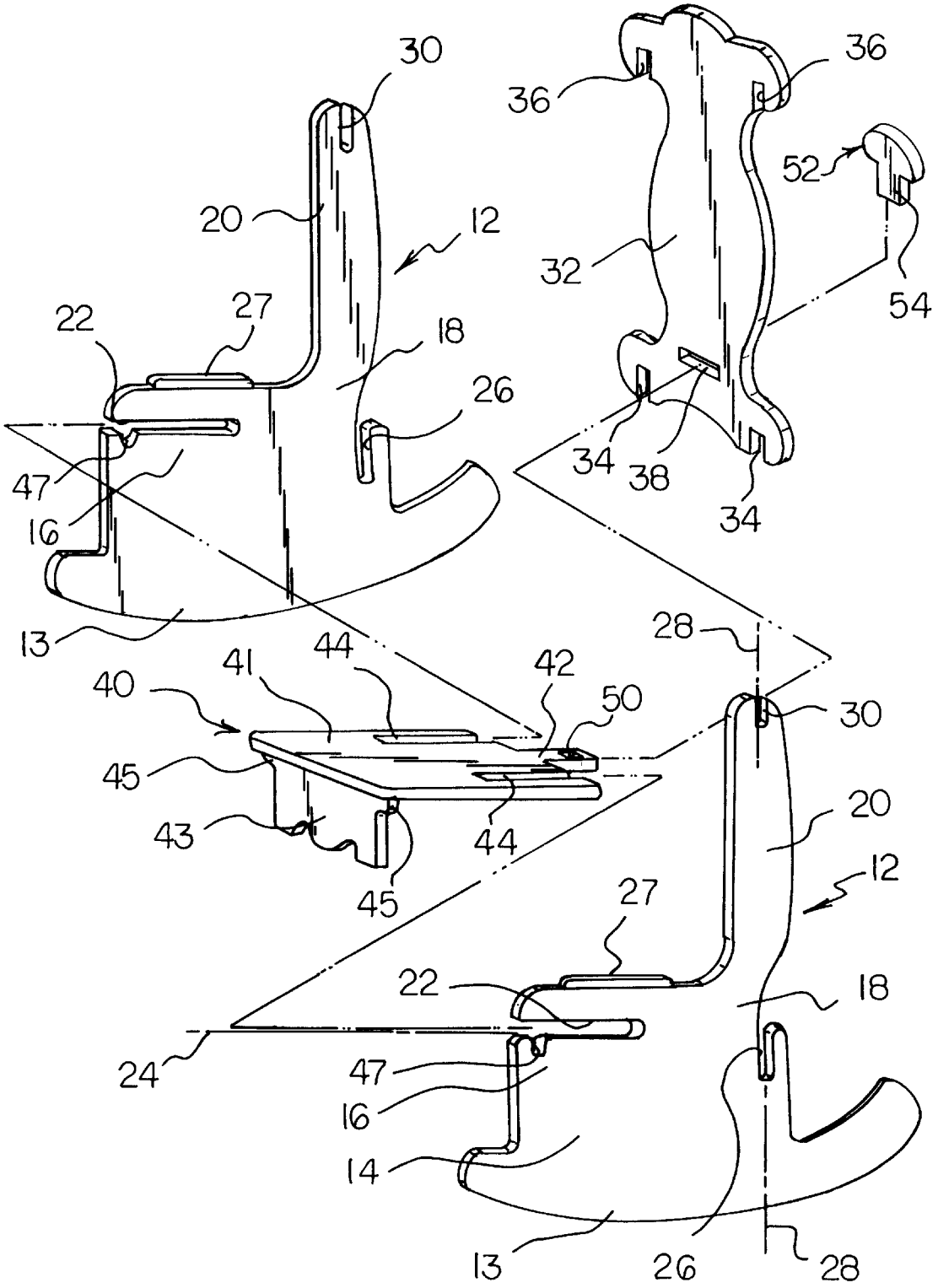
FIG. 5 is an exploded perspective view of the embodiment of the invention shown in FIG. 1.

Turning to FIGS. 1–5, there is shown an exemplary embodiment of the collapsible chair apparatus of the invention generally designated by reference numeral 10. In its preferred form, collapsible chair apparatus 10 includes a pair of planar side panels 12 each of which includes a lower side panel portion which includes a front lower region 16 and a rear lower region 18. Each side panel 12 also includes an upper side panel portion 20 which extends upward from the rear lower region 18. A front slot 22 extends into the front lower region 16 at a first orientation 24. A lower rear slot 26 extends into the rear lower region 18 at a second orientation 28. An upper rear slot 30 extends into the upper side panel portion 20 at the second orientation 28 coplanar with the lower rear slot 26. A planar back panel 32 includes a pair of lower back slots 34 which are oriented at the second orientation 28 and which are registrable with the lower rear slots 26 of the side panels 12. A pair of upper back slots 36 in the back panel 32 are oriented at the second orientation 28 and are registrable with the upper rear slots 30 of the side panels 12. A lock-tab receiving channel 38 is present in the back panel 32 and is coplanar with the front slots 22 of the side panels 12.

A seat assembly 40 includes a planar seat panel 41 and a spacer element 43 which projects downward from a front portion of the seat panel 41. As shown in the disassembled view of FIG. 5, the spacer element 43 is secured to the planar seat panel 41. The seat panel 41 includes a rear locking tab 42 that is registrable with the lock-tab receiving channel 38 in the back panel 32 and includes a pair of rear seat slots 44 oriented at the first orientation 24 and registrable with the front slots 22 of the side panels 12. A locking element is provided which is attachable to the rear locking tab 42 of the seat assembly 40 for locking the seat assembly 40 onto the back panel 32. An arm rest element 27 may be attached to each of the side panels 12. If desired, the arm rest elements 27 can be permanently affixed, such as with an adhesive, to the respective side panels 12.

The spacer element 43 includes a pair of laterally extending spacer lock tabs 45, and each of the front lower regions 16 of the side panels 12 includes a spacer-tab receiving notch 47 for receiving a spacer lock tab 45. As shown in the drawings, the spacer lock tabs 45 on each side of the spacer element 43 each have an unobstructed free end (not labeled) which allows for assembly of the invention 10 with the spacer element 43 secured to the planar seat panel 41. When the collapsible chair apparatus 10 is in the form of a rocking chair, each of the lower side panel portions 14 of the side panels 12 includes a rocker portion 13. The rear locking tab 42 of the seat assembly 40 includes a peg-receiving aperture 50, and the locking element is comprised of a locking peg 52 which includes a locking portion 54 which is received in the peg-receiving aperture 50. The first orientation 24 and the second orientation 28 are perpendicular to each other. Preferably, the first orientation 24 is substantially horizontal, and the second orientation 28 is substantially vertical.

To assemble the collapsible chair apparatus 10 from its component parts, one of the side panels 12 is held in one hand of a person, such as a child, and the back panel 32 is held in the other hand. A first side of the back panel 32 is aligned with the selected side panel 12 so that the lower back slot 34 on the first side of the back panel 32 is juxtaposed to the lower rear slot 26 on the hand-held side panel 12 and so that the upper back slot 36 on the first side of the back panel 32 is juxtaposed to the upper rear slot 30 on the hand-held side panel 12. Then, the back panel 32 and the hand-held side panel 12 are moved towards each other. This results in the lower rear slot 26 interfitting with the lower back slot 34 and the upper rear slot 30 interfitting with the upper back slot 36. Then, the hand-held side panel 12 is released.

Next, the person grasps the second side panel 12 and moves the second side panel 12 to the unattached second side of the back panel 32. The unattached upper back slot 36 of second side of the back panel 32 is placed in juxtaposition with the upper rear slot 30 of the second side panel 12, and the unattached lower back slot 34 of the second side of the back panel 32 is placed in juxtaposition with the lower rear slot 26 of the second side panel 12. Then, the back panel 32 and the second side panel 12 are pushed towards each other so that the lower rear slot 26 of the second side panel 12 interfits with the lower back slot 34 on the second side of the back panel 32, and so that the upper rear slot 30 of the second side panel 12 interfits with the upper back slot 36 on the second side of the back panel 32.

Next, the back panel 32 is released, and the seat assembly 40 is picked up. The rear seat slots 44 of the seat panel 41 are placed in juxtaposition with the front slots 22 of the side panels 12, and the side panels 12 and the seat assembly 40 are pushed towards each other. When this occurs, the front slots 22 of the side panels 12 interfit with the rear seat slots 44 of the seat panel 41. Moreover, when the seat assembly 40 and the side panels 12 are pushed towards each other, the spacer element 43 is positioned between the two side panels 12.

When the spacer element 43 is positioned between the two side panels 12, the front lower region 16 of each of the side panels 12 can then be positioned laterally over the unobstructed free end of the spacer lock tab 45 on the respective side of the spacer element 43. Furthermore, the rear locking tab 42 on the seat panel 41 passes through the lock-tab receiving channel 38 on the back panel 32. It is noted that the spacer element 43 serves to provided reinforcement for the collapsible chair apparatus 10. More specifically, the spacer element 43 prevents the side panels 12 from moving towards one another under the weight of someone sitting in the assembled collapsible chair apparatus 10. Then, both the seat assembly 40 and the side panels 12 can be released. Then, the locking portion 54 of the locking peg 52 is inserted in the peg-receiving aperture 50 of the rear locking tab 42. As long as the locking peg 52 is locked into the rear locking tab 42, the seat assembly 40 cannot be pulled away from the back panel 32 or the side panels 12, the back panel 32 cannot be pulled away from the seat panel 41 and the side panels 12, and the side panels 12 cannot be pulled away from each other. In other words, the presence of the locking peg 52 in the rear locking tab 42 prevents the collapsible chair apparatus 10 from being disassembled.

To disassemble the collapsible chair apparatus 10 for storage or transportation, the locking peg 52 is removed from the rear locking tab 42, the seat assembly 40 is pulled away from the back panel 32 and the side panels 12, and the back panel 32 is pulled away from the side panels 12.

The components of the collapsible chair apparatus of the invention can be made from inexpensive, durable, and light weight wood and plastic materials. A variety of child-appealing colors can be used.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved collapsible chair apparatus that is low in cost, relatively simple in design and operation, and which may advantageously be collapsed so as to occupy less space in storage and so as to be more easily transported from one location to another. With the invention, a collapsible chair apparatus is provided which does not include a large number of slats that have to be placed in a corresponding large number of mortises. With the invention, a collapsible chair apparatus is provided which does not include pivotal connections between component parts. With the invention, a collapsible chair apparatus is provided which has interfitting slots, wherein the back of the chair is prevented from disconnecting from the remainder of the chair if the back of the chair is used for lifting the chair vertically. With the invention, a collapsible chair apparatus is provided which does not require any nails or glue for assembly.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A collapsible chair apparatus, comprising:

a pair of planar side panels each of which includes a lower side panel portion which includes a front lower region and a rear lower region, an upper side panel portion which extends upward from said rear lower region, a front slot extending from a forward edge of the side panel and into said front lower region at a first orientation, a lower rear slot extending into said rear lower region at a second orientation, and an upper rear slot extending into said upper side panel portion at said second orientation coplanar with said lower rear slot, a planar back panel which includes a pair of lower back slots oriented at said second orientation and registrable with said lower rear slots of said side panels, a pair of upper back slots oriented at said second orientation and registrable with said upper rear slots of said side panels, and a lock-tab receiving channel coplanar with said front slots of said side panels, a seat assembly which includes a planar seat panel and a spacer element which projects downward from a front portion of said seat panel, wherein said seat panel includes a rear locking tab that is registrable with said lock-tab receiving channel in said back panel and a pair of rear seat slots oriented at said first orientation and registrable with said front slots of said side panels, and a locking element attachable to said rear locking tab of said seat assembly for locking said seat assembly onto said back panel;

wherein the spacer element is secured to the seat panel, the spacer element including a pair of laterally extending spacer lock tabs;

wherein each of said front lower regions of said side panels includes a spacer-tab receiving notch for receiving one of the spacer lock tabs, the spacer-tab receiving notch extending into communication with the front slot of the respective side panel;

wherein the spacer lock tabs each have an unobstructed free end such that when the spacer element is positioned between the two side panels, the front lower region of each of the side panels is laterally positionable over the unobstructed free end of the respective spacer lock tab of the spacer element.

2. The apparatus of claim 1, further including:

an arm rest element attached to each of said side panels.

3. The apparatus of claim 1 wherein each of said lower side panel portions of said side panels includes a rocker portion.

4. The apparatus of claim 1 wherein:

said rear locking tab of said seat assembly includes a peg-receiving aperture, and said locking element is comprised of a locking peg which includes a locking portion which is received in said peg-receiving aperture.

5. The apparatus of claim 1 wherein said first orientation and said second orientation are perpendicular to each other.

6. The apparatus of claim 1 wherein said first orientation is substantially horizontal and said second orientation is substantially vertical.

* * * * *